United States Patent [19]

Hayashi et al.

[11] 4,074,090

[45] Feb. 14, 1978

[54] DISTRIBUTOR ROTOR ELECTRODE HAVING SILICON COATING FOR SUPPRESSING PEAKS OF CAPACITY DISCHARGE CURRENT

[75] Inventors: Minoru Hayashi, Toyota; Mineo Ogino, Aichi; Toshihiko Kobayashi, Toyoake; Masaki Noda, Toyota, all of Japan

[73] Assignee: Toyota Jidosha Kogyo Kabushiki Kaisha, Japan

[21] Appl. No.: 684,361

[22] Filed: May 7, 1976

[51] Int. Cl.[2] ..... H01H 19/00; H01H 1/02

[52] U.S. Cl. ..... 200/19 DR; 123/146.5 A; 123/148 R; 200/267; 200/270

[58] Field of Search ..... 123/146.5 A, 148 R, 123/148 P, 148; 200/19 R, 19 DC, 19 DR, 262–270; 252/500, 512

[56] References Cited

U.S. PATENT DOCUMENTS

| | | | |
|---|---|---|---|
| 2,464,533 | 3/1949 | Shearer | 200/267 X |
| 2,949,803 | 8/1960 | Leslie | 200/267 X |
| 3,017,532 | 1/1962 | Talmey | 200/267 X |
| 3,663,777 | 5/1972 | Steinmetz et al. | 200/270 X |
| 4,039,787 | 8/1977 | Hori et al. | 200/19 DC X |

FOREIGN PATENT DOCUMENTS

| | | | |
|---|---|---|---|
| 376,235 | 11/1939 | Italy | 200/19 DR |

*Primary Examiner*—James R. Scott

*Attorney, Agent, or Firm*—Oblon, Fisher, Spivak, McClelland & Maier

[57] ABSTRACT

A distributor constructed by providing a silicon coating on a surface of a rotor brush thereof. Only the end surface of the rotor brush is coated, employing an ion-plating coating method.

4 Claims, 8 Drawing Figures

DISTRIBUTOR ROTOR ELECTRODE HAVING SILICON COATING FOR SUPPRESSING PEAKS OF CAPACITY DISCHARGE CURRENT

BACKGROUND OF THE INVENTION

1. Field of the Invention

The present invention relates generally to a distributor and more particularly to a rotor brush of distributor treated to suppress electromagnetic noise waves, hereinafter referred to simply as noise waves, generated by the distributor.

2. Description of the Prior Art

It is well known that a distributor provided in a vehicle, such as an automobile or the like, generates noise waves by spark discharges intermittently generated at high rates which interfere with radio and television broadcasting, various kind of radio communication, etc.

These noise waves are becoming an increasingly serious problem because of the recent tendency towards the generation of a strong spark discharge in an ignition device by a large current in a short time in order to purify the exhaust gases.

Hitherto, various proposals have been made for suppressing these noise waves, but exceedingly few of them have been put into practical use because of their high cost in the mass production of vehicles or because of their poor performance. Typical of the noise suppressing means which have been put into practical use is one in which the surface of at least one of the discharge electrodes respectively provided on the rotor brush and a side terminal, which are facing each other to form a discharge gap in the distributor, is additionally provided with a coating of highly resistive material, as mentioned in the specification of Japanese Patent Application No. Sho 49-072663, corresponding to U.S. patent application Ser. No. 566,935, filed Apr. 10, 1975. Now U.S. Pat. No. 4,007,342 issued Feb. 8, 1977. For example, a rotor brush is composed of a silicon wafer, the surface of which is formed with a coating of highly resistive material or a silicon oxide coating by the silicon wafer per se. Alternatively, the rotor brush and side terminal are each composed of a brass material or a resistive alloy invar or the like and the surface of each of the respective discharge electrodes of the rotor brush and the side terminal is deposited, by a spraying method, with a resistive material, such as copper oxide, aluminum oxide, resistive alloy invar or the like.

In the examples described herein, silicon is the most superior material in providing nose wave suppressing characteristics. However, silicon has certain disadvantages in that it is very expensive for the mass production of vehicles and it requires after-treatment to form a coating of silicon oxide as a highly resistive material. While a rotor brush, upon which copper oxide or the like is spray-deposited, is economically practical, there are other disadvantages in such cases in that such a sprayed rotor brush is inferior to the silicon wafer rotor brush as to the noise wave suppressing effect attained, in that the surface of such a sprayed rotor requires shot-blast treatment and further requires a deposition by spraying of nickel aluminide or the like as a foundation, in order to increase the stickiness thereof prior to the treatment of spraying copper oxide or the like, and in that the discharging gap has to be specially designed taking into consideration the thickness of the sprayed material, which comes to several millimeters.

SUMMARY OF THE INVENTION

Accordingly, to solve the problems of the prior methods, as described herein, an object of the present invention is to provide a distributor rotor brush which is more suitable for mass production and is less expensive than conventional ones and superior to these in noise wave suppressing capability, considering the good characteristic of silicon in noise wave suppressing and the inexpensiveness of brass or the like.

It is a further object of the present invention to provide an improved method of forming a silicon coating on a surface of a distributor rotor brush.

The foregoing and other objects are attained according to the present invention by providing a silicon coating on a surface of the distributor rotor brush by an ion-plating method.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views and wherein.

DESCRIPTION OF THE PREFERRED EMBODIMENT

Figure 1:
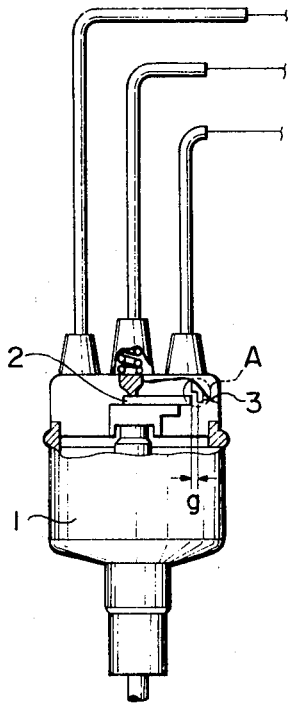
FIG. 1 PRIOR ART
FIG. 1 is a partially sectional elevation view of a conventional distributor rotor brush.

Referring now to FIG. 1, a distributor 1 is conventionally composed of a rotor brush 2 adapted to rotate in association with a driving rotary shaft of an internal combustion engine and a plurality of side terminals 3 are arranged adjacent to a locus of the rotation of the rotor brush 2, with a discharge gap g being provided therebetween.

Figure 2:
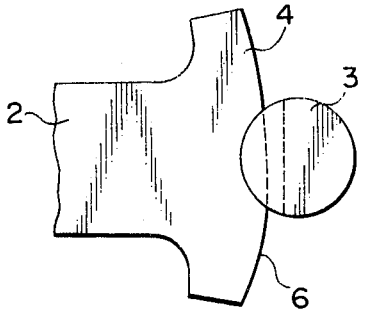
FIG. 2 is an enlarged plan view of the portion shown within a circle A of FIG. 1, when the present invention is applied thereto.
Figure 3:
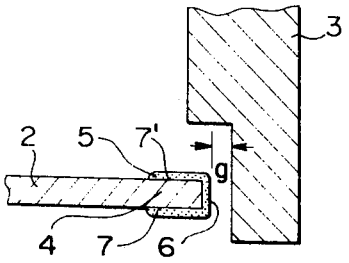
FIG. 3 is a sectional elevation view of FIG. 2.
Figure 4:
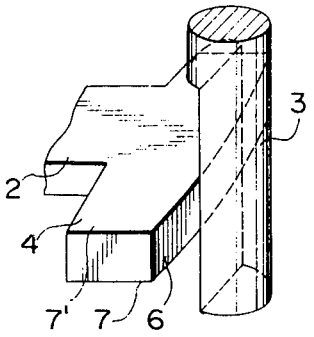
FIG. 4 is a perspective view of FIG. 2.

FIGS. 2–4 are enlarged detail views of the portion disposed within the area of a circle A, as shown in FIG. 1, when the present invention is applied thereto. A silicon coating 5 of about 5–15 $\mu$ thickness is formed on the surface of the rotor brush 2, or only on the surface of a discharge electrode portion 4 at the end portion of the rotor brush 2. Sufficient performance is obtained if the silicon coating 5 is formed on the surface of the discharge electrode portion 4 of the rotor brush 2. Further, even when the silicon coating 5 is formed only on the surface of the discharge electrode portion 4, it is sufficient for good performance to form the silicon coating mainly on the peripheral edge surface 6 facing the side terminals and only on the portions of the respective upper and lower surfaces 7 and 7', which are perpendicular to the surface 6 and are adjacent thereto. As the material composing the rotor brush 2, any commonly used good electro-conductive material, such as brass, steel or the like, may be employed.

The formation of the silicon coating 5 on the surface of the rotor brush 2 may be achieved by an ion-plating method described hereinafter.

Figure 5:
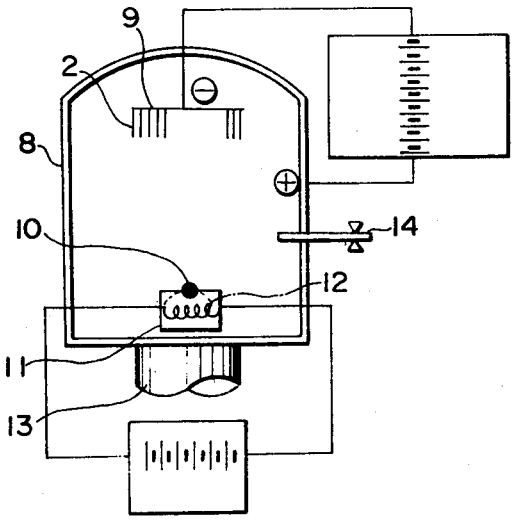
FIG. 5 is a sectional view of a silicon ion-plating device.
Figure 6:
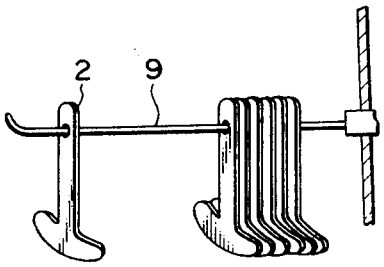
FIG. 6 is a perspective view of rotor brushes in the device of FIG. 5.

After lightly washing with trichlene or the like, a great number of the rotor brushes 2 are closely hung by a supporting rod 9 or the like in a vacuum container 8, as shown in FIG. 5. At the same time, a mass of silicon 10, consisting of high purity silicon, is set a certain distance from and facing the edge surfaces 6 of the discharge electrodes 4 of the rotor brushes 2. After a vacuum is applied to the container 8, by means of an exhaust device 13, argon gas or the like is introduced to the vacuum area in the container 8 through a gas introducing device 14, thereby providing an inactive gas atmosphere of argon gas or the like of about $10^{-3}$ torr. A bias voltage of several KV is applied between the container, which is grounded to be set at zero potential, and the rotor brush 2 in such a manner that the container functions as a positive electrode and the brushes as a negative electrode.

Thus, a glow discharge is generated to ionize the inactive argon gas or the like into positive ions which rush onto the surface of the rotor brushes 2, which are maintained at negative potential.

The surface of each rotor brush 2 is scraped at a rate of some Ansgtroms per minute by the ions. In this case, if any oxide has been attached on the surface thereof, the portion attached with oxide is concentratedly scraped by the ions of the inactive gas. A stain or oxide coating on the surface only preliminarily cleaned with trichlene or the like can be readily removed within 10 minutes per sputter-cleaning by the ions. Next, the pressure in the container 8 is depressed to about $10^{-5}$ torr to vaporize the mass of silicon 10 by means of an electron beam, plasma arc or the like.

When using the electron beam method, an electron beam 12 is generated by an electron beam generator 11 and is suitably deflected by application of a magnetic field, so as to irradiate on the mass of silicon 10 and thereby fuse and vaporize the mass of silicon 10. The vaporized silicon is attached to the discharge electrode 4 of each rotor brush 2, mainly on the edge surface 6, which is disposed in facing relation to the mass of silicon 10, and is further attached to a certain extent to the upper and lower, or side flat surfaces 7 and 7' perpendicular to the surface 6. Thus, ion-plating is effected. About 5–20 minutes irradiation to vaporize the silicon is sufficient to form a silicon coating 5 of about 5–15 $\mu$ thickness. The after-treatment step to form a silicon oxide coating, which is necessary for the known silicon wafer rotor brush or a rotor brush sprayed with silicon, is not required when the silicon coating is formed by the present ion-plating method.

The experimental results of the characteristics in noise wave suppressing effect of the rotor brush formed with a silicon coating according to the present invention and the influence of the thickness of the silicon coating will be described next.

Figure 7:
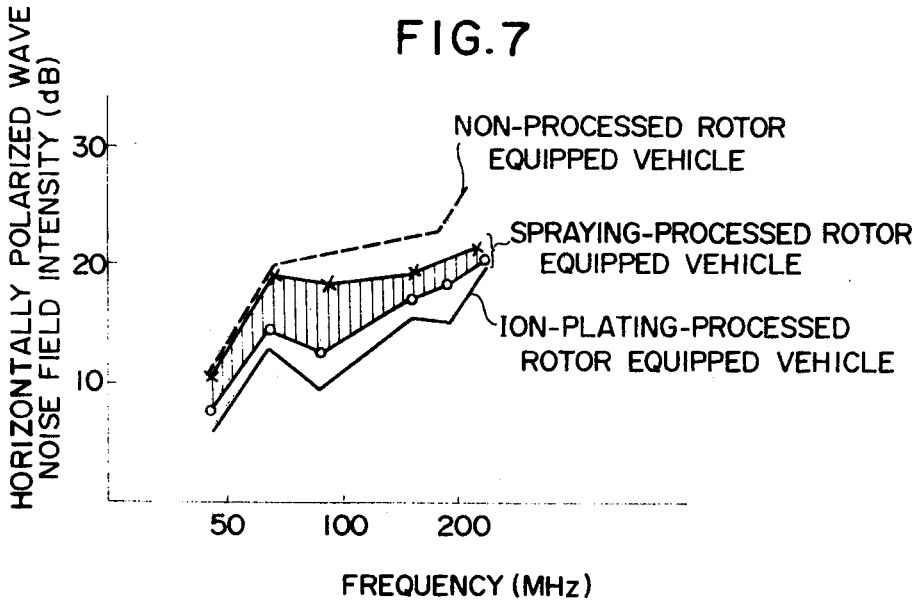
FIG. 7 is a graph comparing the characteristics in noise wave suppressing effect of a rotor brush according to the present invention with the conventional ones.

FIG. 7 shows the measured results of the noise wave field intensity, comparing the case when the distributor 1 containing a rotor brush 2 formed with a silicon coating according to the present invention is actually mounted on a vehicle with the case when a distributor containing a conventional rotor brush sprayed with copper oxide is mounted on a vehicle and with the case when a distributor having an untreated rotor brush is mounted on a vehicle. In FIG. 7, the ordinate axis represents the noise wave field intensity (dB) on the horizontally polarized wave plane and the abscissa axis represents the frequency (MHz) of the measured noise waves.

It is apparent from FIG. 7 that the horizontally polarized noise wave field intensity, when the silicon ion-plated rotor brush is employed, is always lower than that when the non-treated rotor brush or the rotor brush sprayed with highly resistive material is employed in all the frequencies within the measured range. This means that, according to the present invention, the noise wave suppressing effect is very remarkably improved, by greatly reducing the noise wave field intensity.

Figure 8:
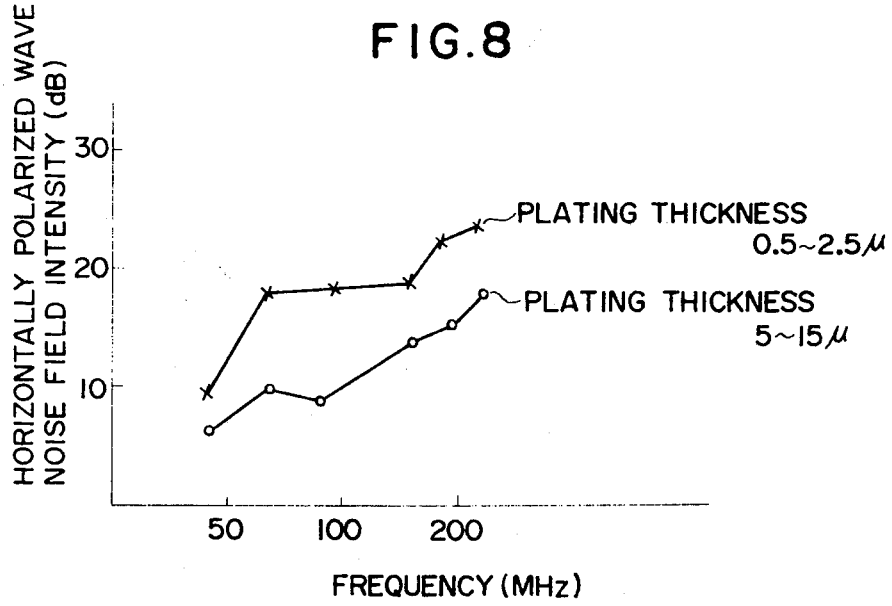
FIG. 8 is a graph showing the characteristic of the rotor brush according to the present invention when the thickness of the silicon plating is changed.

FIG. 8 shows the effect on the horizontally polarized noise wave field intensity when the thickness of the silicon layer formed by ion-plating is changed. As seen from this figure, the thickness of about 5–15 $\mu$ of ion-plated silicon layer results in a satisfactory effect to suppress noise waves. The rotor brush thus treated by the ion-plating method and having a silicon coating of about 5–15 $\mu$ thickness shows the same excellent effect in noise wave suppressing capabilities as the silicon wafer rotor brush. Even if the thickness of the silicon coating is further increased above the thickness of 15 $\mu$, the effect cannot be much improved. When the thickness of the silicon coating is selected to be only about 0.5–2.5 $\mu$, the noise wave suppressing effect may deteriorate with long use. However, if the thickness is selected to be more than 5 $\mu$, the noise wave suppressing characteristic is maintained quite stable without changing from its initial state and withstands long usage.

When the brush according to the present invention is used, an extremely remarkable effect for suppressing noise waves is obtained which is far superior to the rotor brush having a sprayed copper oxide coating and is the same as the silicon wafer rotor brush, which shows the most superior characteristic in noise wave suppressing effect among the conventional rotor brushes treated by various kinds of methods for forming a coating of a highly resistive material thereon. Further, preliminary treatments, such as shot-blast or the like, which are always required in the highly resistive material spraying method and the treatment of spraying nickel aluminide or the like to form a foundation are not required in the method according to the present invention. Such treatment is replaced by the sputter cleaning by gas ions in the method of the present invention, resulting in a great simplification of the preliminary treatment. Additionally, an after-treatment to form silicon oxide coating, such as is required in the production of the silicon wafer brush, is also unnecessary in the method of the present invention.

Still further, since a very thin 5–15 $\mu$ ion-plated layer shows a sufficient performance for suppressing noise waves, even if a rotor brush presently in use is treated, according to the present invention, without changing its present shape, the change of the discharge gap between the rotor brush and the side terminals is negligibly small. Therefore, the present invention does not have the problem that arises in the spraying method wherein consideration must be given beforehand to the thickness of the sprayed layer is planning and manufacturing.

Obviously, many modifications and variations of the present invention are possible in light of the above teachings. It is therefore to be understood that within the scope of the appended claims, the invention may be practiced otherwise than as specifically described herein.

What is claimed as new and desried to be secured by Letters Patent of the United States is:

1. In a distributor having a rotor brush with a discharge electrode portion adapted to rotate in association with a driving rotory shaft of an internal combustion engine and side terminals arranged adjacent to a locus of rotation of the rotor brush with a discharge gap provided therebetween, the improvement comprising a noise wave suppressing ion-plating formed silicon coating disposed on the surface of the discharge electrode portion of the rotor brush to suppress the peaks of capacity discharge current.

2. A distributor according to claim 1 wherein the silicon coating is disposed on an upper, a lower and a side surface of the discharge electrode portion of the rotor brush.

3. A distributor according to claim 1 wherein the silicon coating is disposed only on a side surface of the discharge electrode portion of the rotor brush facing the side terminals.

4. A distributor according to claim 1, wherein the thickness of the silicon coating is 5–15 $\mu$.

* * * * *